US006128832A

United States Patent [19]

Stueble

[11] Patent Number: 6,128,832

[45] Date of Patent: Oct. 10, 2000

[54] METHOD AND SYSTEM FOR PROVIDING CONDITIONED AIR

[75] Inventor: Helmut Stueble, Spartanburg, S.C.

[73] Assignee: LTG Air Engineering, Inc., Spartanburg, S.C.

[21] Appl. No.: 09/326,382

[22] Filed: Jun. 4, 1999

[51] Int. Cl.[7] ..... F26B 3/00

[52] U.S. Cl. ..... 34/448; 34/474; 34/487; 34/631; 34/632; 34/633; 34/638; 34/654; 57/308; 19/66 C

[58] Field of Search ..... 34/419, 422, 448, 34/452, 459, 474, 487, 68, 85, 629, 631, 632, 633, 635, 638, 654; 19/66 R, 66 C, 65 A, 200; 57/300, 302, 301, 304, 306, 308, 406, 411, 415

[56] References Cited

U.S. PATENT DOCUMENTS 4,570,682 2/1986 Bachmann ..... 139/1
5,157,910 10/1992 Artzt et al. ..... 57/308
5,472,018 12/1995 Verner et al. ..... 139/1
5,575,143 11/1996 Gengler ..... 57/308
5,666,996 9/1997 Bollier et al. ..... 139/1
5,709,721 1/1998 Stueble ..... 55/212

*Primary Examiner*—Pamela A. Wilson
*Attorney, Agent, or Firm*—Dority & Manning

[57] ABSTRACT

A system and method for providing conditioned air to a yarn traveling on a textile machine includes an air conditioning unit local to said textile machine and configured to receive input air and to condition the air to a first desired relative humidity. An air delivery conduit is in communication with the air conditioning unit and conveys the conditioned air therefrom. A diffuser is in communication with the delivery conduit so that the conditioned air flows into the diffuser. The diffuser defines a nonuniform opening so that the conditioned air leaves the diffuser in a turbulent flow. The opening is disposed at a predetermined distance from the yarn so that an air mixture, comprising the turbulent conditioned air and ambient air drawn into the turbulent flow, has a second desired relative humidity upon reaching the yarn.

38 Claims, 7 Drawing Sheets

METHOD AND SYSTEM FOR PROVIDING CONDITIONED AIR

BACKGROUND OF THE INVENTION

The present invention relates to a process and system for air conditioning, in particular to deliver humidified air to an area of a textile machine that requires specific air conditions.

During the weaving process, warp yarn is subjected to very high tensile strain. If the yarn is too dry, excessive yarn breaks result, disrupting production and reducing product quality. Since yarn tensile strength and stretching ability increase with moisture content, humidity control is important at the shedding area of looms that weave cotton and other natural and synthetic fibers.

It is well known to condition air in textile mills to maintain a desired relative humidity level, typically around 60 percent in most areas and 75% in the weave room. The higher weave room level is needed to assure a relative humidity level around 65% at the area between a weaving machine's fabric beam and warp beam. Mill employees, however, may find a lower relative humidity level, for example ranging between 40 percent and 60 percent, more comfortable.

SUMMARY OF THE INVENTION

The present invention recognizes and addresses disadvantages of prior art constructions and methods.

Accordingly, it is an object of the present invention to provide an efficient air conditioning system for weaving machines.

This and other objects of the present invention may be achieved by a system for providing conditioned air to yarn traveling on a textile machine. The system includes an air conditioning unit local to the textile machine and configured to receive input air and to condition the air to a first desired relative humidity. An air delivery conduit is in communication with the air conditioning unit and conveys the conditioned air therefrom. A diffuser is in communication with the delivery conduit so that the conditioned air flows into the diffuser. The diffuser defines a nonuniform opening so that the conditioned air leaves the diffuser in a turbulent flow. The opening is disposed at a predetermined distance from the yarn so that an air mixture, comprising the turbulent conditioned air and ambient air drawn into the turbulent flow, has a second desired relative humidity upon reaching the yarn.

In another embodiment of the present invention, a method for providing conditioned air to yarn traveling on a textile machine includes conditioning air to a first desired relative humidity and conveying the conditioned air to a position proximate the yarn. The conditioned air is directed to the yarn in a turbulent flow so that an air mixture, comprising the turbulent conditioned air and ambient air drawn into the turbulent flow, has a second desired relative humidity upon reaching the yarn. Air is drawn into an intake proximate the yarn and is directed to the air conditioning unit.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 1:
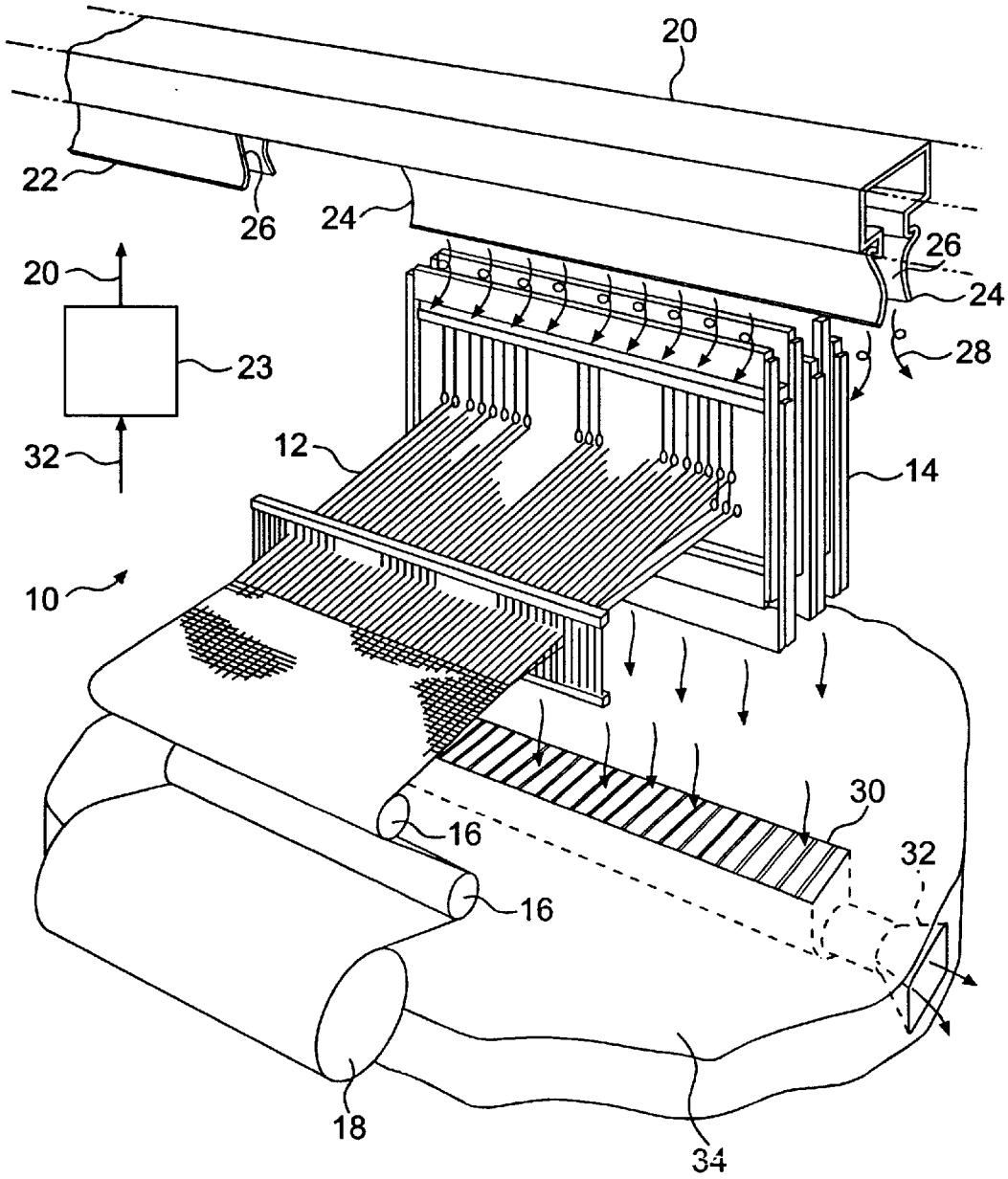
FIG. 1 is a perspective and schematic illustration of an embodiment of an air conditioning system according to the present invention.

Repeat use of reference characters in the present specification and drawings is intended to represent same or analogous features or elements of the invention.

DETAILED DESCRIPTION OF PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

FIG. 1 illustrates an air conditioning system 10 that provides conditioned air to yarn 12 at the shedding area of a loom (illustrated in part in FIG. 1). The shedding area includes a series of heddles 14 that define numerous heddle eyes through which the warp yarn elements pass. As the heddles selectively move the yarn elements up or down, a reed (not shown) moves back and forth to move weft yarn into position, thus forming a woven fabric. The fabric is tensioned by S-rollers 16 and finally rolled up onto a beam 18. Although a loom is described in the figures, it should be understood that the present invention could be used in conjunction with other machines requiring a predetermined humidity level. The construction and operation of looms and other such machines should be understood by those skilled in this art and are therefore not discussed in further detail herein.

As noted in the background section, it is important to maintain a desired relative humidity at the loom's shedding area. If the yarn is too dry, it may tend to break. If too wet, the yarn elements may undesirably stick to each other. Accordingly, an air delivery conduit 20 delivers conditioned air to the loom through a diffuser 22. The conduit may include any suitable arrangement for conveying air, for example including pipes or ducts, and may have many branches that extend throughout the textile mill. Since a diffuser may be disposed at each loom, a given branch may include several diffusers.

Conditioned air is provided to air delivery conduit 20 by an air conditioning unit 23 shown schematically in FIG. 1. Air conditioning unit 23 may be part of the primary air conditioning system for the textile mill and may be constructed in any suitable manner, for example including an air washer, as should be understood by those skilled in this art. Conduit 20 may branch off of its main air conditioning output or may be directed from a separate air conditioning unit. An exemplary air conditioning system is described in detail in U.S. Pat. No. 5,497,628, the entire disclosure of which is incorporated by reference herein for all purposes.

Air conditioning unit 23 conditions the air, for example bringing it to a desired temperature and relative humidity, and discharges it to diffuser 22 through delivery conduit 20. Part or all of the air in the conduit is diverted into the diffuser and through a nonuniform opening in the diffuser. A "nonuniform" opening as described herein refers to an opening that defines some obstacle and/or boundary shape, such as a bottleneck or flared curve, that varies the air flow across the opening's cross-section. Thus, air exiting the opening travels at different speeds and/or in different directions across the flow's cross-section, thereby creating a turbulent air flow.

In the embodiment as shown in FIG. 1, the nonuniform opening is defined between a pair of arcuate plates 24 that define convex sides 26 that oppose each other to form a bottleneck. As indicated by lines 28, the restricted opening creates a turbulent air flow leaving the diffuser opening. The turbulent air mixes with the mill's interior ambient air and flows down to yarn 12.

Because of the mixture, and assuming that the ambient air does not have the same relative humidity as the conditioned air, the relative humidity of the air reaching yarn 12 is different than that of the conditioned air leaving the diffuser opening. For example, air exiting the diffuser may preferably have a relative humidity between 80 percent and 90 percent. It mixes with the drier ambient air so that the mixture reaching the yarn has a desired humidity. Given the air flow rate from the diffuser, the distance of the diffuser opening from the yarn, the width between plates 24 and the relative humidity levels of the diffuser air and ambient air, relative humidity at the yarn can be predicted using standard induction tables, as should be understood in this art. The humidity desired for the yarn depends, for example, on the yarn type, the sizing used on the yarn, and the machine type.

System dimensions and characteristics can vary as needed or desired. In an exemplary arrangement as shown in FIG. 1, where the diffuser opening may be 600 mm from yarn 12, the conditioned air provided by air conditioning unit 23 may have a relative humidity of 95% as it leaves the diffuser. The ambient air relative humidity may be 55%. Conditioned air may flow through the diffuser opening at a rate of 400 $m^3$/h per unit length (in meters) of the opening in diffuser 22 (hereinafter described as m/h/m), and the minimum distance between convex sides 26 may be 50 mm. Under such conditions, the relative humidity of the mixed air reaching yarn 12 is approximately 65%. Because the diffuser opening extends over the entire width of the shedding area, the relative humidity across yarn 12 is more consistent than in prior systems.

Upon passing yarn 12, the mixed air is drawn into a return intake 30 to a return air conduit 32 running through the mill floor 34. A grating or other suitable covering is optionally provided over the intake. Air is drawn into intake 30 by a fan or other suction source between the intake and delivery conduit 20. For example, the fan may be located in air conditioning unit 23. Intake 30 is proximate yarn 12. In the embodiment illustrated in FIG. 1, it is disposed in a position so that the air mixture is received from the yarn. That is, it is in a position so that it receives fibers and other matter carried by the mixture from the yarn which is then removed from the air by a downstream filter. Of course, the intake may also receive ambient air that does not pass directly from the yarn.

Figure 2:
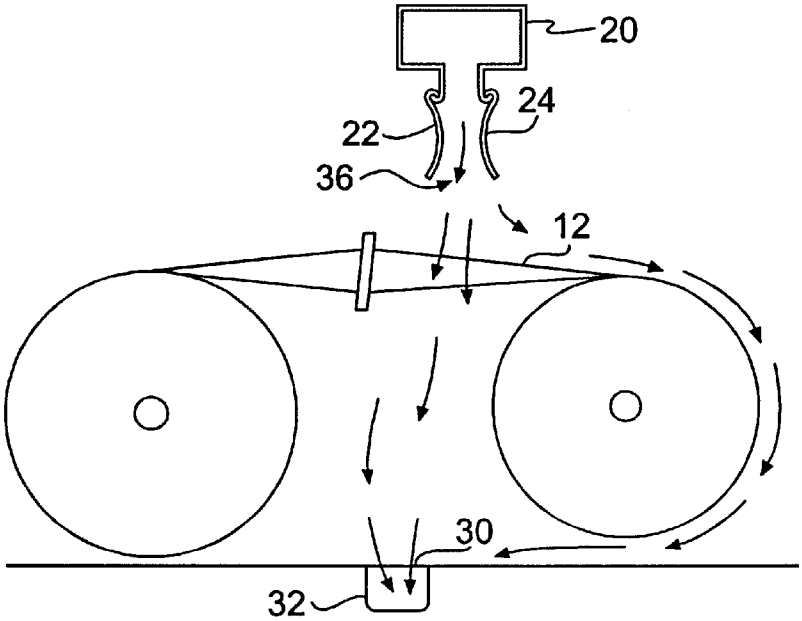
FIG. 2 is a partial schematic illustration of an embodiment of an air conditioning system in accordance with the present invention.

Because the diffusers direct conditioned air to relatively precise positions within the mill, it is necessary to condition a far lesser volume of air to the higher relative humidity level than in prior systems. Thus, even though the conditioned air exiting the diffuser may need to be conditioned to between 80% and 95% relative humidity, the lesser air volume involved reduces the total required energy. Energy requirements can be further minimized by bringing the diffuser opening relatively close to the yarn. Referring to FIG. 2, for example, diffuser opening 36 is approximately 150 mm to 600 mm (6–24 inches) above yarn 12. A lesser air flow rate, for example 150 $m^3$/h/m–600 m/h/m, is needed at such distances. The diffuser, however, should create a relatively high degree of turbulence. Arrangements to increase turbulence are discussed in more detail below.

Figure 3:
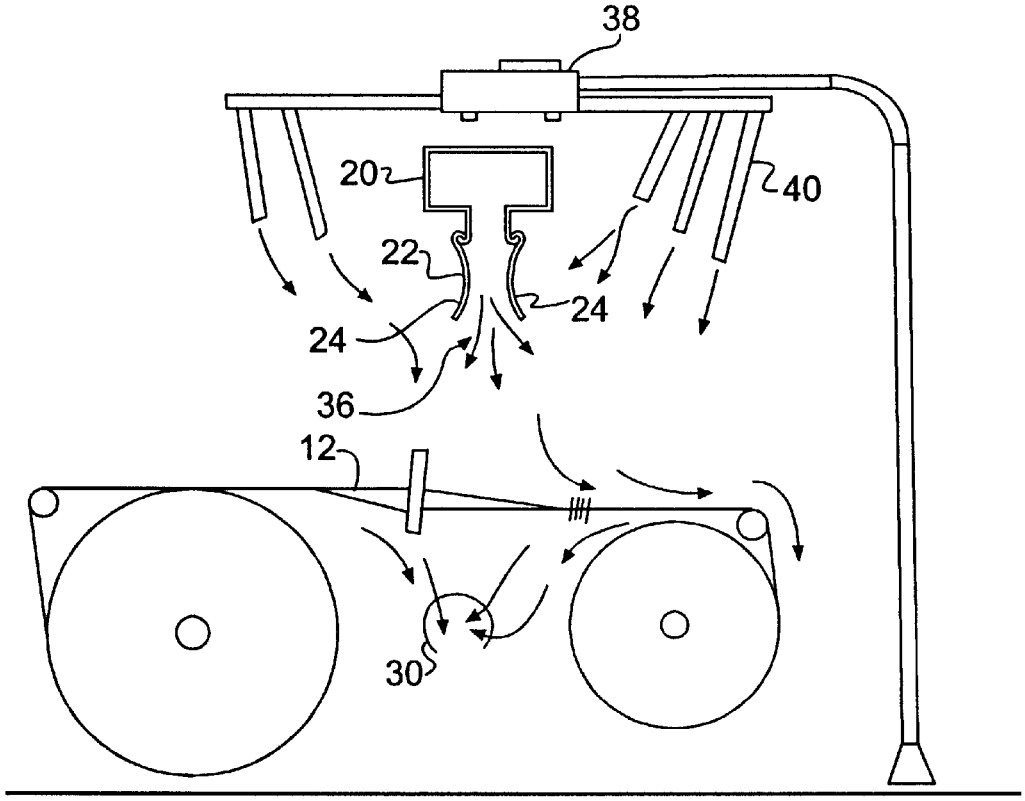
FIG. 3 is a partial schematic illustration of an embodiment of an air conditioning system in accordance with the present invention.

The turbulent air flow is more stable than a laminar air flow. Thus, the diffuser may be placed farther away from, or at oblique angles with respect to, the warp yarn to accommodate physical restrictions in the mill such as traveling cleaners. Referring to FIG. 3, for example, delivery conduit 20 is disposed so as not to interfere with a traveling cleaner 38. Such cleaners should be well understood by those skilled in this art and are therefore not discussed in detail herein. Briefly, however, the cleaner includes several nozzles 40 that blow air onto the weaving machine to dislodge fibers and dust therefrom. This air is then drawn into intake 30 and filtered downstream. The increased air flow toward the yarn caused by the traveling cleaner may alter the relative humidity of the air mixture at the yarn. Since the traveling cleaner only briefly passes by any given machine, however, this effect is minimal.

The diffuser opening 36 in FIG. 3 is positioned at a medium distance, for example between 600 mm and 1200 mm, above yarn 12. Again assuming that the ambient air's relative humidity is approximately 55%, that air from delivery conduit 20 is provided at a rate of 400–700 $m^3$/h/m and at a relative humidity of 95%, and that the distance between plates 24 at their closest point is 50 mm, the relative humidity of the mixed air at the yarn is approximately 65%.

Figure 4:
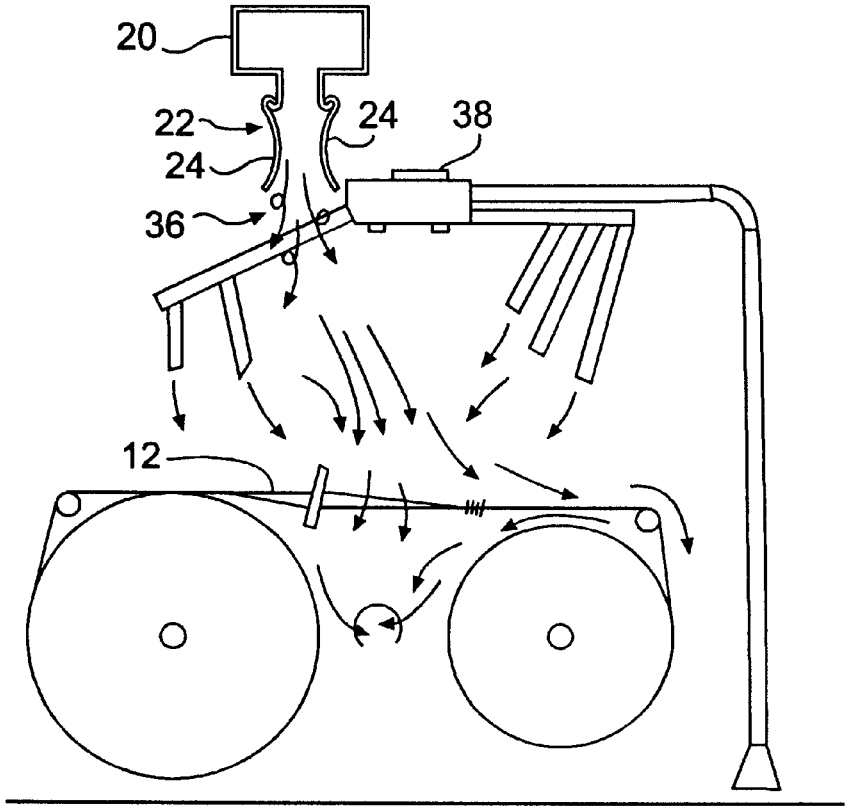
FIG. 4 is a partial schematic illustration of an embodiment of an air conditioning system in accordance with the present invention.

FIG. 3 also indicates that the air return conduit need not be disposed in the mill floor. As indicated in the Figure, intake 30 is disposed above the floor surface and may be, for example, part of an above-ground duct system.

Where conditions do not permit the diffuser's location to be as close to the yarn as described above, a diffuser according to the present invention may be placed still further from the yarn. Referring to FIG. 4, for example, opening 36 is approximately 1000 mm from yarn 12. Assuming 55% ambient relative humidity, 95% conditioned air relative humidity, a minimum distance of 50 mm between plates 24, and an opening 36 that is approximately 400 mm laterally offset from the center of the shedding area, the relative humidity at the yarn is approximately 65%.

Figure 5:
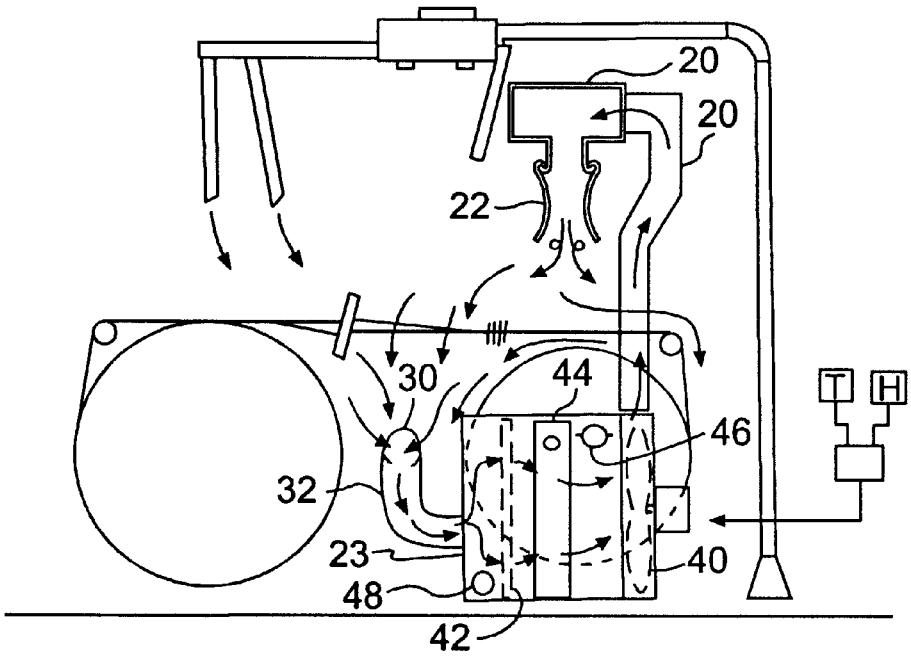
FIG. 5 is a partial schematic illustration of an embodiment of an air conditioning system in accordance with the present invention.

While the above examples assume an air conditioning unit that delivers conditioned air to many or all of the weaving machines in a mill, it should be understood that local air conditioning units may be used as well. For example, referring to FIG. 5, a local air conditioning unit 23 includes a housing enclosing a fan 40 that draws air into intake 30 and through return conduit 32 as well as an air filter 42 and heat exchanger 44. The heat exchanger may cool the air to a desired relative humidity, for example using cooling fins or coils as should be understood in the art. It should be understood that any suitable heat exchange device may be employed. A bypass, indicated by a damper switch 46, may extend from the area in the air conditioning unit between filter 42 and heat exchanger 44 to the area between the heat exchanger and fan 40, thereby providing an air flow path around the heat exchanger. The ratio of air passing through the heat exchanger to the air passing through the bypass may be adjusted to achieve desired conditions. A general air conditioning unit may also employ air mixing, as described in U.S. Pat. No. 5,497,628.

Temperature and humidity sensors may be placed proximate the weaving machine to determine air conditions thereabout. The sensors are in communication with a processor 47 that determines when such conditions justify opening damper 46, or a similar damper in a general air conditioning unit, to allow air mixing. A second damper 48 extends through the air conditioning housing to allow cleaning of filter 42. Fan 40 drives the conditioned air into delivery conduit 20 to diffuser 22.

Figure 6:
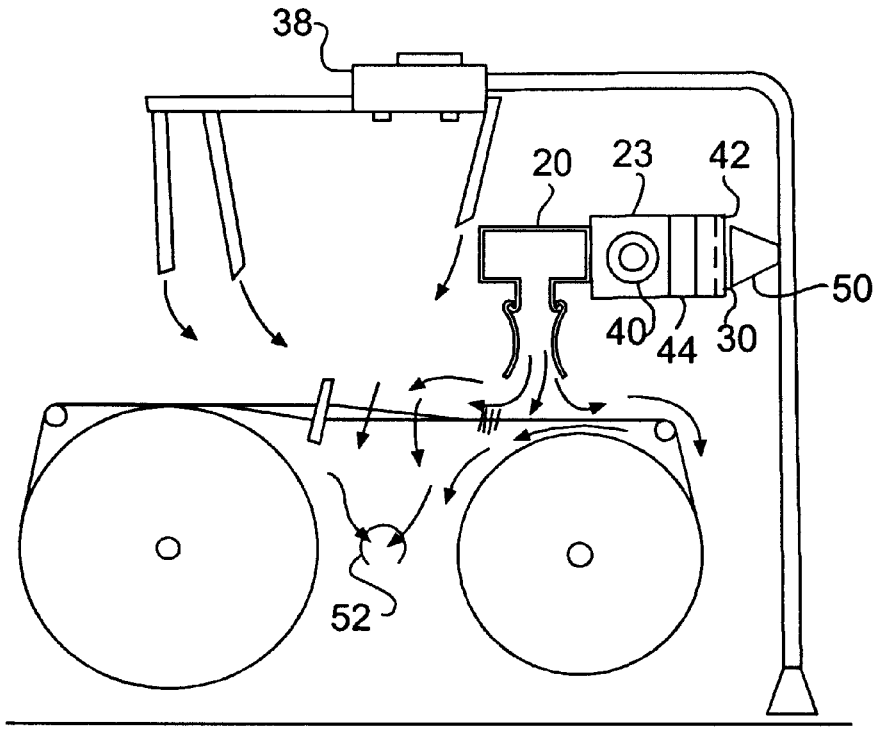
FIG. 6 is a partial schematic illustration of an embodiment of an air conditioning system in accordance with the present invention.

It should be understood that various configurations and arrangements of local air conditioning units may be employed within the present invention. Referring to FIG. 6, for example, air conditioning unit 23 is disposed above the weaving machine. An air filter 42 extends across intake 30 so that the filter is exposed. Heat exchanger 44 and fan 40 are disposed between filter 42 and delivery conduit 20. The return conduit is limited to the intake area.

A suction nozzle 50 of a traveling cleaner 38 may periodically clean the exposed filter 42. An intake 52 that is not connected to the local unit may also draw air through a duct line (not shown) to the mill's general air conditioning unit.

Figure 7:
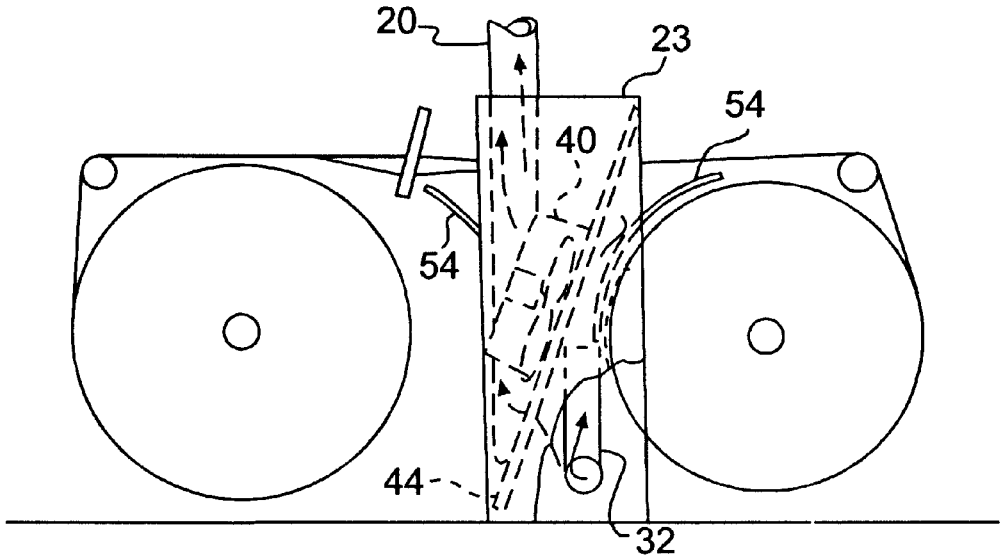
FIG. 7 is a partial schematic illustration of an embodiment of an air conditioning system in accordance with the present invention.

In the embodiment shown in FIG. 7, the air intake is in the form of a trough 54 that extends across and underneath the length of the warp to catch debris therefrom. The air flow from the trough is fed to delivery conduit 32 which, in turn, directs the air into the housing of air conditioning unit 23. Fan 40 draws the air through a filter 44 and out through a delivery conduit 20 to a diffuser (not shown) disposed in an appropriate position above the yarn.

Figure 8:
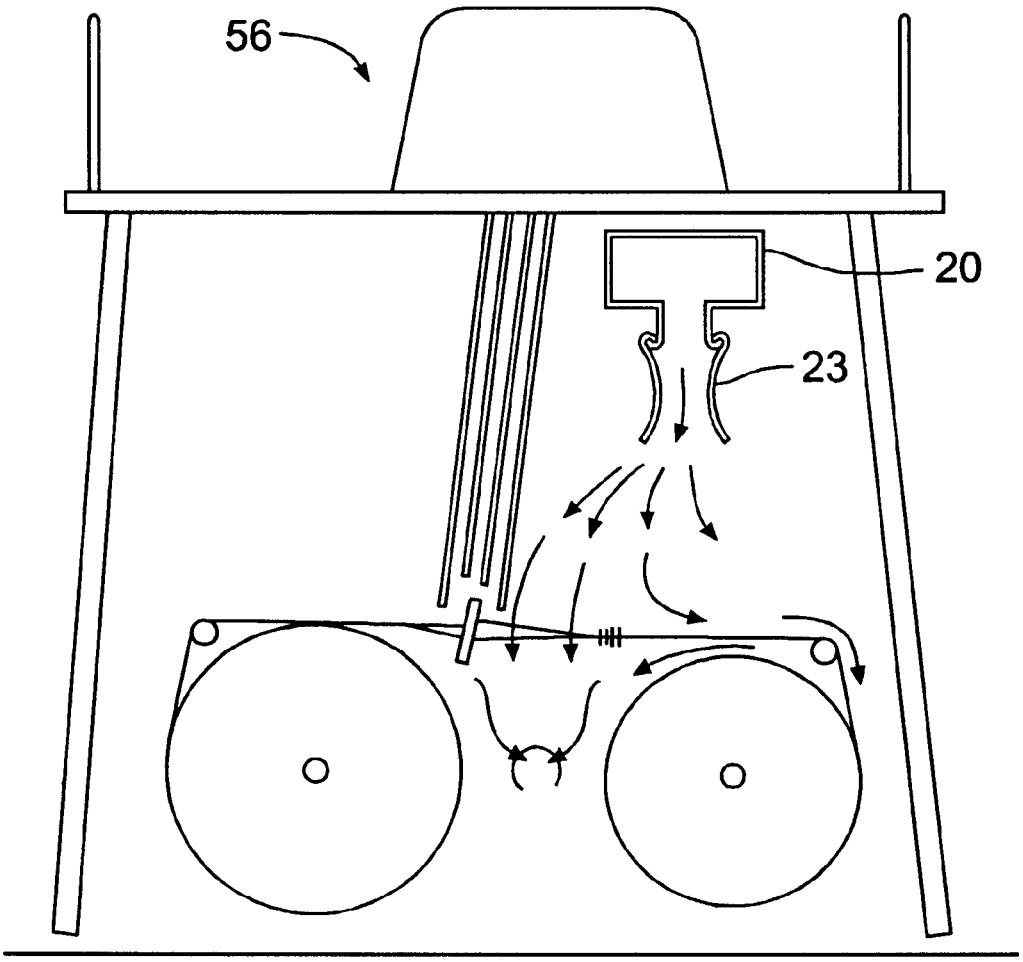
FIG. 8 is a partial schematic illustration of an embodiment of an air conditioning system in accordance with the present invention.

It should also be understood that the air conditioning system of the present invention may be used with any suitable textile machine, for example a jacquard loom indicated at 56 in FIG. 8.

While FIGS. 1–8 schematically illustrate the diffusers, it should be understood that many suitable diffuser constructions may be employed within the present invention. For example, plates 24 in the embodiments depicted in FIGS. 4–6 and 8 are preferably pivoted so that the diffuser opening is directed toward the loom shedding area, rather than straight down. A construction allowing such arrangement is show in FIG. 9.

Figure 9:
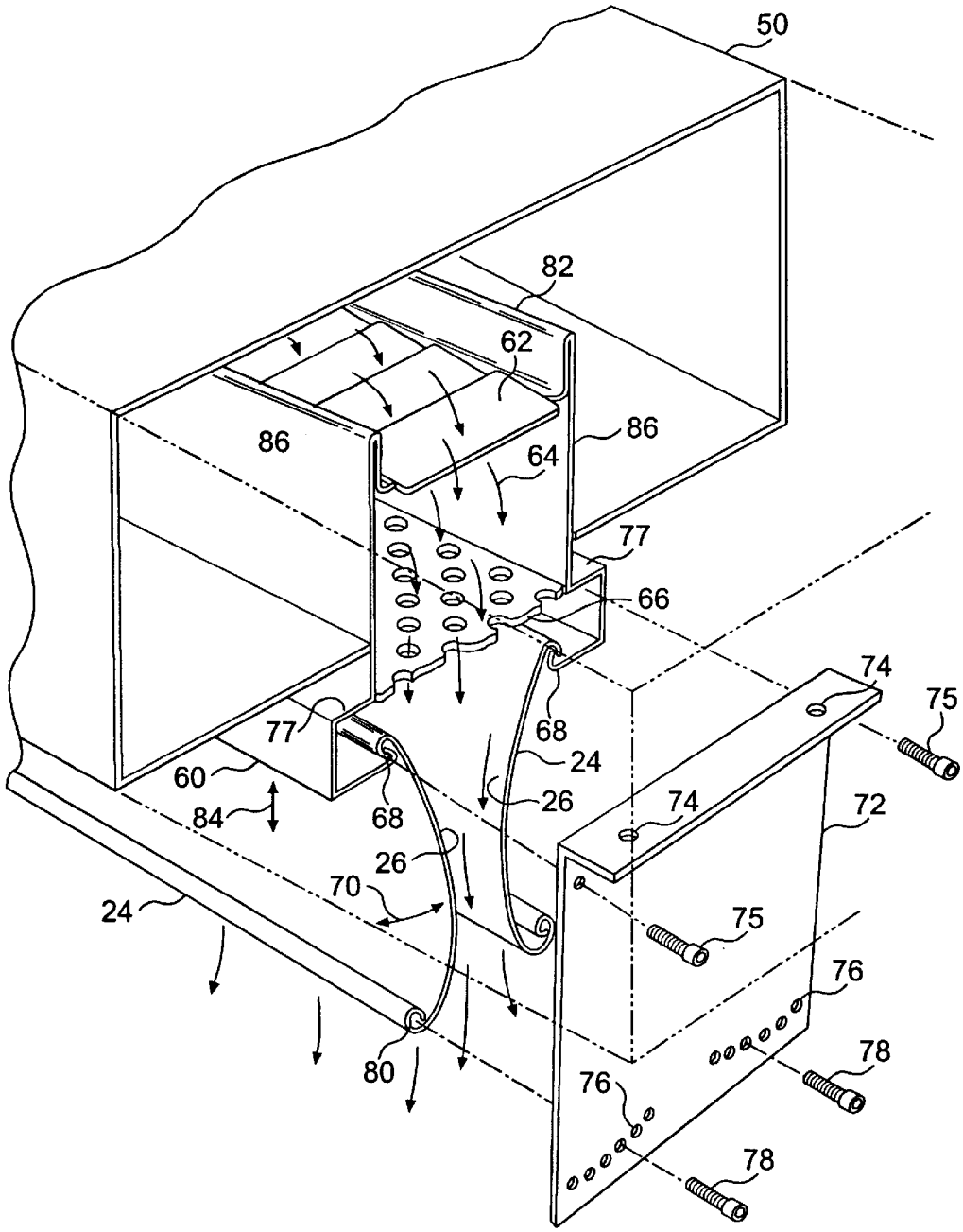
FIG. 9 is a partial exploded view of an air delivery conduit and diffuser for use in an air conditioning system in accordance with an embodiment of the present invention.

Referring to FIG. 9, the delivery conduit comprises an air duct 58 that receives a diffuser housing 60. The housing includes a series of baffles 62 (or other structure such as a grating) at a top end thereof that direct conditioned air traveling through duct 58 into the diffuser housing interior, as indicated by arrows 64. A perforated plate 66 is mounted in and extends laterally across the diffuser housing below the baffles. The plate spreads the air flow out across the diffuser so that a relatively uniform flow is directed to the opening defined between plates 24. Since the conditioned air flows downward through the diffuser opening, the perforated plate is disposed generally perpendicularly to this air flow, of course, since the bottleneck between plates 24 creates a nonlaminar air flow, the air flow does not move in an entirely downward direction. As indicated above, however, the flow is generally downward, and the perforated plate is therefore considered to be "generally" perpendicular to the flow.

Plates 24 are mounted to housing 60 at hinges 68 so that they are pivotal from side to side as indicated by arrow 70. A side plate 72 is mounted by bolts (not shown) to duct 58 through holes 74. A pair of bolts 75 extend through the side plate and under respective shoulders 77 of housing 60. Alternatively, bolts 77 may be secured to housing 60 by brackets that are attached to the housing and to which the bolts thread or are otherwise secured.

The side plate defines a plurality of holes 76 on either side through which respective pins 78 extend. These pins are received by respective holes 80 in plates 24 to secure the plates in desired positions. Thus, plates 24 may be moved inwardly and outwardly to define the minimum spacing between them. This determines the degree to which the plates create a bottleneck and, therefore, the degree of turbulence of the outgoing air. The plates may also be positioned to direct air from the diffuser opening in a desired direction, for example at an oblique angle, with respect to vertical, toward a loom's shedding area.

As noted above, it may be desirable to change the distance between the diffuser opening and the yarn. Accordingly, side plate 72 may be configured to extend into duct 58 so that it covers the entire side of diffuser housing 60 and extends from a top edge 82 of the housing to the bottom of plates 24. In this embodiment, the side plate is attached to the diffuser housing by suitable means, for example bolts or clips. The duct vertically slidably receives the diffuser housing as indicated by arrow 84. A suitable seal may be disposed around the opening in duct 58 that receives the housing to minimize or prevent an air leak. A series of brackets extending downward from duct 58 mate with corresponding holes in housing side walls 86. The distance that the diffuser opening extends downward from the duct is determined by sliding the housing to a desired position and securing it by bolts extending through the brackets and their respective holes.

In another embodiment, the diffuser defines an accordion section or a telescopic section between side walls 86 and the bracket portion of housing 60 that defines hinges 68. Thus, the diffuser opening may be pulled down or pushed up to a desired position and held there by a latch between the duct and the diffuser housing.

Figure 10:
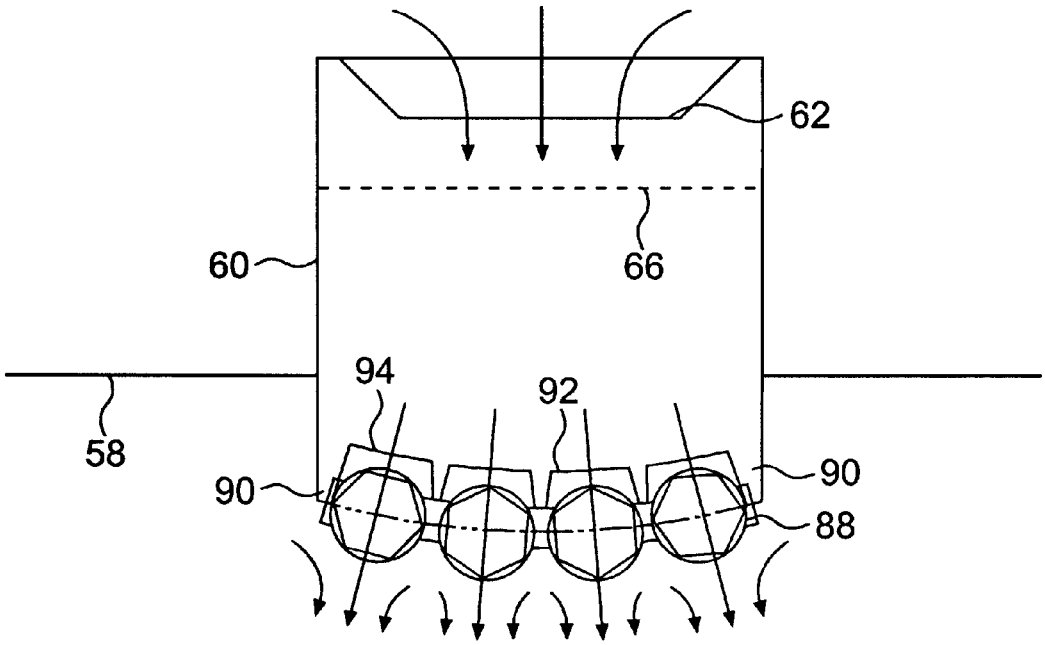
FIG. 10 is a schematic illustration of a diffuser for use in an air conditioning system in accordance with an embodiment of the present invention.

It should also be understood that there may be many suitable configurations of the diffuser. For example, referring to FIG. 10, the diffuser includes an arcuate barrier 88 that extends across the diffuser opening. The downward-facing convex barrier includes a plurality of parallel cylindrical tubes 92 having through-cuts extending longitudinally along opposite sides of each tube so that an air flow path is defined through the barrier. The polymer tubes are held by aluminum brackets 90 and clips 94. Because the tubes are aligned in a curve, the air passages through them are non-parallel with respect to each other. This arrangement generates generally high turbulence and may therefore be appropriate in arrangements where the diffuser is relatively close to the yarn as described above. A turbulent diffuser as shown in FIG. 10 is available from LTG Air Engineering, Inc. of Spartanburg, S.C. under the name LTB LINEAR DIFFUSER.

While one or more preferred embodiments of the invention have been described above, it should be understood that any and all equivalent realizations of the present invention are included within the scope and spirit thereof. The embodiments depicted are presented by way of example only and are not intended as limitations upon the present invention. Thus, it should be understood by those of ordinary skill in this art that the present invention is not limited to these embodiments since modifications can be made. Therefore, it is contemplated that any and all such embodiments are included in the present invention as may fall within the literal or equivalent scope of the appended claims.

What is claimed is:

1. A system for providing conditioned air to yarn/traveling on a textile machine, said system comprising:

an air conditioning unit local to said textile machine and configured to receive input air and to condition said air to a first desired relative humidity;

an air delivery conduit in communication with said air conditioning unit and conveying said conditioned air therefrom; and a diffuser in communication with said delivery conduit so that said conditioned air flows into said diffuser, wherein said diffuser defines a nonuniform opening so that said conditioned air leaves said diffuser in a turbulent flow and wherein said opening is disposed at a predetermined distance from said yarn so that an air mixture, comprising said turbulent conditioned air and ambient air drawn into said turbulent air flow, has a second desired relative humidity upon reaching said yarn.

2. The system as in claim 1, wherein said local air conditioning unit includes an air intake, a heat exchanger, a fan disposed between said heat exchanger and said delivery conduit, and an air filter operatively disposed between said intake and said heat exchanger.

3. The system as in claim 2, wherein said local air conditioning unit includes a fan disposed between said heat exchanger and said output.

4. The system as in claim 2, wherein said local air conditioning unit includes an air bypass around said heat exchanger between said intake and said delivery conduit.

5. The system as in claim 1, wherein said local air conditioning unit defines an air intake and includes a filter operatively disposed at said intake.

6. The system as in claim 5, wherein said local air conditioning unit includes a heat exchanger disposed between said filter and said delivery conduit.

7. The system as in claim 1, wherein said predetermined distance is within the range of 575 mm to 1250 mm.

8. The system as in claim 7, wherein said predetermined distance is greater than 1150 mm.

9. The system as in claim 1, wherein said opening is defined between a pair of arcuate plates disposed with respect to each other so that respective convex sides of said plates oppose each other.

10. The system as in claim 9, wherein said diffuser includes a housing mounted to said delivery conduit and wherein said arcuate plates are pivotally mounted to said housing so that said convex sides are movable reciprocally with respect to each other.

11. The system as in claim 1, wherein said diffuser includes a housing mounted to said delivery conduit and a perforated plate disposed in said housing and generally perpendicularly to an air flow of said conditioned air through said opening.

12. The system as in claim 1, wherein said diffuser includes a housing mounted to said delivery conduit, wherein an arcuate barrier is attached to said housing and extends across said opening, and wherein said arcuate barrier defines a convex surface at an outward side of said opening and a plurality of spaced apart passages extending through said barrier and said surface.

13. A system for providing conditioned air to yarn traveling on a textile machine, said system comprising:

an air conditioning unit configured to receive input air and to condition said air to a first desired relative humidity;

an air delivery conduit in communication with said air conditioning unit and conveying said conditioned air therefrom;

a diffuser in communication with said delivery conduit so that said conditioned air flows into said diffuser, wherein said diffuser defines a nonuniform opening so that said conditioned air leaves said diffuser in a turbulent flow and wherein said opening is disposed at a predetermined distance from said yarn so that an air mixture, comprising said turbulent conditioned air and ambient air drawn into said turbulent flow, has a second desired relative humidity upon reaching said yarn; and an air return conduit extending between said yarn and said air conditioning unit, said conduit defining an intake proximate said yarn.

14. The system as in claim 13, wherein said intake is disposed with respect to said yarn so that said intake receives at least a portion of said air mixture from said yarn.

15. The system as in claim 13, wherein said air conditioning comprises an air washer.

16. The system as in claim 13, including an air filter operatively disposed between said intake and an outlet of said air conditioning unit.

17. The system as in claim 13, wherein said air conditioning unit is remote from said yarn.

18. The system as in claim 13, wherein said air conditioning unit is local to said textile machine.

19. The system as in claim 18, wherein said air conditioning unit includes a heat exchanger, a fan disposed between said heat exchanger and said delivery conduit, and an air filter operatively disposed between said return conduit and said heat exchanger.

20. The system as in claim 18, including an air filter operatively disposed at said intake so that air received by said intake passes through said filter.

21. The system as in claim 13, wherein said predetermined distance is within a range of 125 mm to 625 mm.

22. The system as in claim 13, wherein said predetermined distance is within a range of 575 mm to 1250 mm.

23. The system as in claim 13, wherein said predetermined distance is greater than 1150 mm.

24. The system as in claim 13, wherein said opening is defined between a pair of arcuate plates disposed with respect to each other so that respective convex sides of said plates oppose each other.

25. The system as in claim 24, wherein said diffuser includes a housing mounted to said delivery conduit and wherein said arcuate plates are pivotally mounted to said housing so that said convex sides are movable reciprocally with respect to each other.

26. The system as in claim 25, including at least one side plate disposed perpendicularly to said convex sides, wherein said side plate defines a series of holes therethrough and wherein each said arcuate plate includes a pin extending therefrom and aligned with said holes to extend therethrough so that said pin retains said plate in a pivotal position with respect to said housing.

27. The system as in claim 13, wherein said diffuser includes a housing mounted to said delivery conduit and a perforated plate disposed in said housing and generally perpendicularly to an air flow of said conditioned air through said opening.

28. The system as in claim 13, wherein said diffuser is extendably configured so that said opening is selectably movable within a predetermined range of said predetermined positions.

29. The system as in claim 13, wherein said diffuser is slidably received by said delivery conduit with respect to a direction extending between said delivery conduit and said yarn.

30. The system as in claim 13, wherein said diffuser includes a housing mounted to said delivery conduit, wherein an arcuate barrier is attached to said housing and extends across said opening, and wherein said arcuate barrier defines a convex surface at an outward side of said opening and a plurality of spaced apart passages extending through said barrier and said surface.

31. A system for providing conditioned air to yarn traveling on a textile machine, said system comprising:

an air conditioning unit configured to receive input air and to condition said air to a first desired relative humidity;

an air delivery conduit in communication with said air conditioning unit and conveying said conditioned air therefrom;

a diffuser in communication with said delivery conduit so that said conditioned air flows into said diffuser, said diffuser including a housing mounted to said delivery conduit, a pair of arcuate plates attached to said housing and disposed with respect to each other so that respective convex sides of said plates oppose each other to define a nonuniform opening between said plates so that said conditioned air leaves said diffuser in a turbulent flow, and a perforated plate disposed in said housing and generally perpendicularly to an air flow of said conditioned air through said opening, wherein said opening is disposed at a predetermined distance from said yarn so that an air mixture, comprising said turbulent conditioned air and ambient air drawn into said turbulent flow, has a second desired relative humidity upon reaching said yarn;

an air return conduit extending between said yarn and said air conditioning unit, said conduit defining an intake proximate said yarn; and an air filter operatively disposed between said intake and an outlet of said air conditioning unit.

32. The system as in claim 31, wherein said intake is disposed with respect to said yarn so that said intake receives at least a portion of said air mixture from said yarn.

33. The system as in claim 31, wherein said air conditioning unit is local to said textile machine.

34. The system as in claim 31, wherein said air conditioning unit includes a heat exchanger, a fan disposed between said heat exchanger and said delivery conduit, and an air filter operatively disposed between said return conduit and said heat exchanger.

35. The system as in claim 31, wherein said arcuate plates are pivotally attached to said housing.

36. A method for providing conditioned air to yarn traveling on a textile machine, said system comprising:

conditioning air to a first desired relative humidity;

conveying said conditioned air to a position proximate said yarn;

directing said conditioned air to said yarn in a turbulent flow so that an air mixture, comprising said turbulent conditioned air and ambient air drawn into said turbulent flow, has a second desired relative humidity upon reaching said yarn; and drawing air into an intake proximate the yarn and directing said drawn air to said air conditioning unit.

37. The method as in claim 36, wherein said drawing step includes drawing air into a said intake disposed with respect to said yarn so that said intake receives at least a portion of said air mixture from said yarn.

38. The method as in claim 36, including filtering said drawn air.

* * * * *